US005800278A

United States Patent [19]

Varriano

[11] Patent Number: 5,800,278

[45] Date of Patent: Sep. 1, 1998

[54] APPARATUS FOR SIGNALING PROPER ALIGNMENT OF USER'S EYE AND OBJECT TO BE STRUCK

[76] Inventor: Marc A. Varriano, 740 Tuckahoe Rd., Apt. 4-F, Yonkers, N.Y. 10710

[21] Appl. No.: 851,674

[22] Filed: May 6, 1997

[51] Int. Cl.[6] ..... A63B 69/36

[52] U.S. Cl. ..... 473/209; 473/268; 473/458; 473/474; 473/224; 473/220

[58] Field of Search ..... 473/209, 268, 473/458, 474, 221, 222, 223, 224, 220; 273/DIG. 17

[56] References Cited

U.S. PATENT DOCUMENTS 5,553,857 9/1996 Fish ..... 473/209

5,685,782 11/1997 Lipps et al. ..... 473/209

*Primary Examiner*—George J. Marlo

*Attorney, Agent, or Firm*—Kilgannon & Steidl

[57] ABSTRACT

A golf, tennis or baseball training apparatus to align the eyes, striking implement and stationary or moving ball to be struck, upon impact. A cap for the user has radiation emitting means mounted to project radiation along the vision path. A radiation detector, an impact detector and a light signaling means are mounted on the striking implement. Processing and decoding circuitry and sound signaling means are mounted on the striking implement or the user. A light or sound signal can signal proper alignment to the user on impact (i.e., essentially simultaneous actuation of radiation and impact detection), and/or can signal improper alignment to the user on impact. The sound signal may be a high or low frequency signal or words from a voice clip. Adjustable radiating beam widths may be used for different levels of skills.

18 Claims, 8 Drawing Sheets

APPARATUS FOR SIGNALING PROPER ALIGNMENT OF USER'S EYE AND OBJECT TO BE STRUCK

BACKGROUND OF THE INVENTION

1. Field of the Invention

This invention relates to an apparatus for signaling to the user whether the user's eyes, a sporting implement for striking an object, and the object are in proper alignment at the time of striking the object with the implement. For example, in striking a baseball, tennis ball or golf ball, the contact against the respective ball by a baseball bat, tennis racquet or golf club is optimally made by having the eyes of the user of the respective striking objects focused on the object to be struck at the moment of impact.

2. Description of the Prior Art

In many sports such as, for example, baseball, tennis and golf, and for which the present invention is particularly useful, proper technique of the physical skills is extremely important in order to play the sport correctly and, therefore, successfully. Within the particularly noted sports, the swing of the baseball bat, the tennis racquet or the golf club are critical to success in a key aspect of each game.

Devices which are aids in developing proper swinging technique include alerting the user as to whether proper head to shoulder position has been attained in swinging a baseball bat. U.S. Pat. No. 5,380,001 describes a sensing mechanism that informs the user by sensing the vertical motion of the head whether the proper head/shoulder relationship has been attained. In U.S. Pat. No. 4,094,504, a signalling device (reed members) is attached to a tennis racquet in a manner such that a proper positioning of the racquet through the swing will give a well-defined audible signal.

Devices aiding the positioning of the head for hitting a baseball or a golf ball are described in U.S. Pat. No. 5,171,152; for initially having a golfer take a proper position vis-a-vis addressing a golf ball, see U.S. Patent No. 5,284,345. Also, in U.S. Pat. No. 4,971,325, an apparatus is described wherein a stationary simulated golf ball has an associated sensor (or an actual golf ball has an associated sensor in the tee) which, upon impact with a simulated golf club head (or an actual golf club head), transmits certain information to a receptor separately disposed from the user and the actual or simulated striking implement. In U.S. Patent No. 4,560,166 there is described a system that provides for sensing the motion of a golfer's head during the swing, sensing the impact of the club with the golf ball, and emitting an alarm signal if the head moves before impact.

None of the aforementioned provide for a detection of the proper alignment of the user's eyes, the striking implement and the object to be struck at the time of contact between the striking implement and the object to be struck, that is operative with either moving or stationary objects to be struck, and that does not require detection equipment other than that which is directly disposed on the person of the user and the striking implement.

SUMMARY OF THE INVENTION

Briefly stated, the invention is an apparatus useful as a training aid in practicing the swing of certain sporting implements so as to have proper alignment of the eyes and the object to be struck upon impact of the sporting implement and the object to be struck. As noted above, it is desirable to have the user, in the instance of baseball and tennis, to follow the baseball or tennis ball to the point of impact with the striking implement. Otherwise stated, the proper mechanics for hitting a baseball is to have the batter follow the baseball from its release point by the pitcher through its traverse to being contacted by the user's swinging baseball bat. So, too, in tennis, the desiderata is to follow the tennis ball propelled toward the user to the surface of the tennis racquet at the moment of impact between the tennis ball and the racquet. While in golf the object to be struck is stationary, it is likewise desirable to assure that the user's eyes and the golf club are aligned at the time of impact between the golf ball and golf club head.

The apparatus of this invention will signal to the user of the apparatus that there is proper alignment of the user's eyes, the striking implement and the object to be struck at the time of impact between the striking implement and the object to be struck. The apparatus comprises (a) a cap to be worn by the user having a radiation or light-emitting means, the radiation or light-emitting means being disposed on the cap to project the radiation or light emission in the same direction as the light path travelling from an object observed by the user to the optic nerve of the user; (b) a radiation or light detector and an impact detector mounted on the striking implement; and (c) processing circuitry and signalling means mounted on the striking implement or person of the user. In the method of this invention, when the baseball bat, tennis racquet or golf club makes contact with the baseball, tennis ball or golf ball, respectively, the impact detector is activated. If, at the time of contact with the striking implement, the user's eyes have followed the baseball or tennis ball to the baseball bat or tennis racquet, or the user's eyes are on the golf ball and golf club, the radiation or light detector together with the impact detector will activate a mechanism that will produce a visual or audible signal signifying the proper alignment of striking implement, object to be struck and the user's eyes. However, if there is not the proper alignment, a different visual or audible signal may be produced.

DETAILED DESCRIPTION OF THE INVENTION

Figure 1:
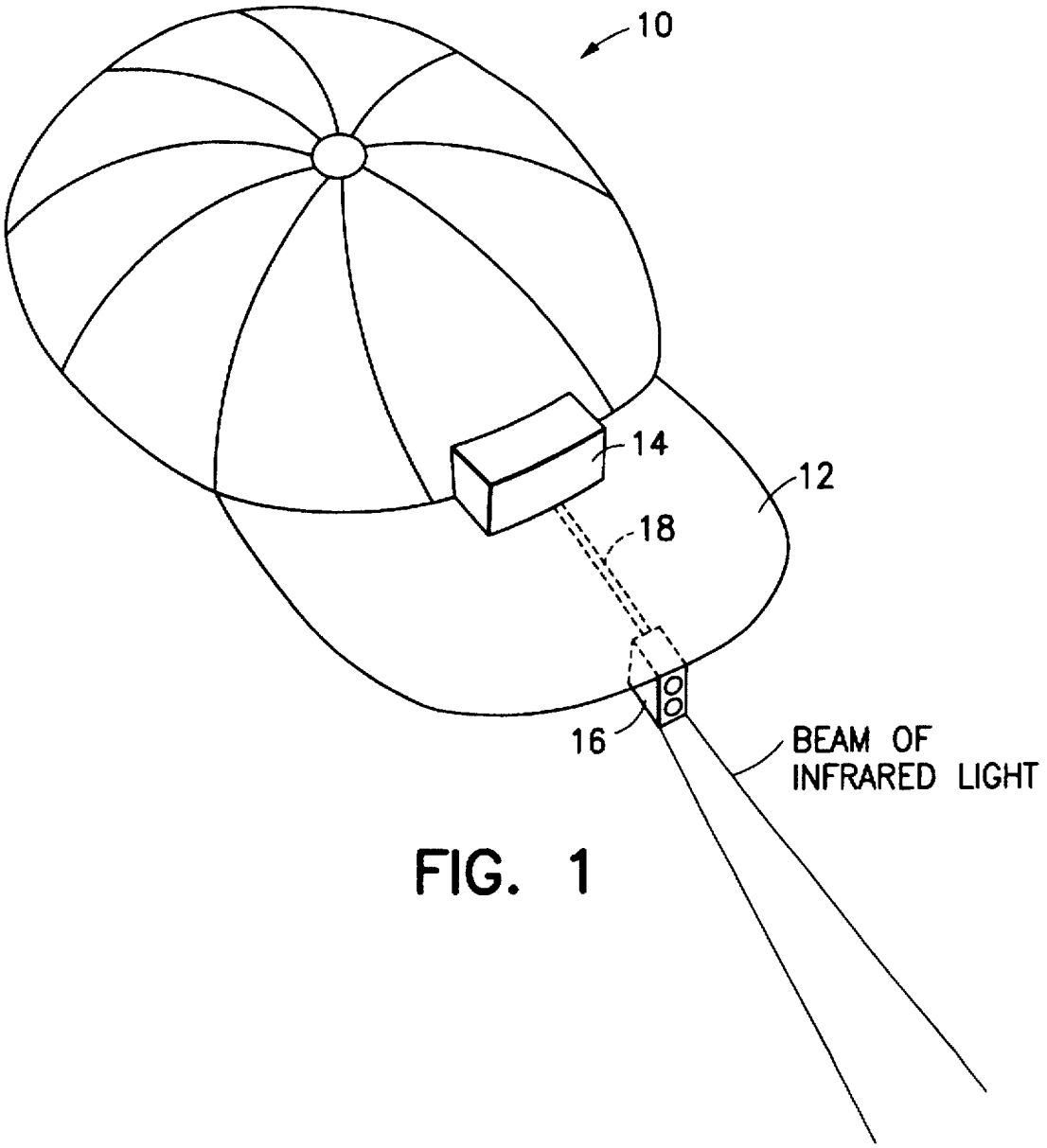
FIG. 1 is a perspective view of a cap showing a radiation-emitting means shown in schematic view.

FIG. 1 shows a cap, generally designated as 10 having a peak portion 12. Mounted on peak 12 and shown in schematic is an enclosure 14 containing batteries and a circuit board, an infrared light-emitting diode (IRLED) 16 and a wire 18 connecting the circuit board 14 and the IRLED 16. Alternatively, the batteries and circuit board may also be packaged together in a single enclosure with IRLED 16, the single enclosure having a clip which allows the single enclosure to be clipped onto peak 12. Important is that the IRLED be disposed on the cap such that the direction of the infrared radiation from the cap is aligned with the direction in which the user's eyes are looking.

Figure 2:
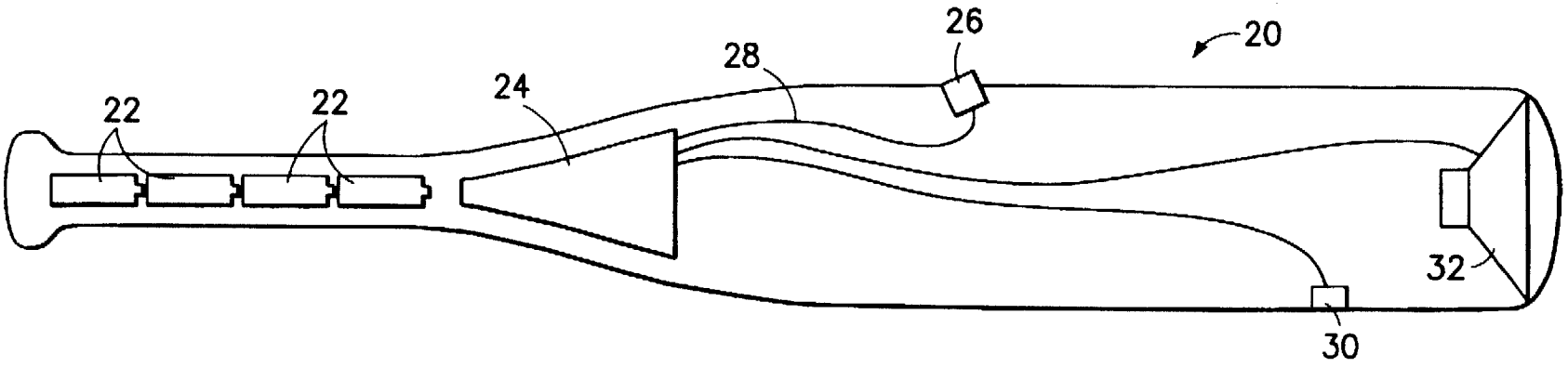
FIG. 2 is a side view of a baseball bat showing, in schematic view, a radiation detector mounted on the baseball bat and an impact detector, and speaker and circuit means mounted within the baseball bat.

In FIG. 2, there is described a baseball bat, generally designated as 20, having disposed within the bat 20, a series of batteries 22 and a circuit board 24 in electrical contact, and an infrared (IR) detector 26 disposed on the surface of the bat 20 and connected to the circuit board 24 through electrical wire 28. Impact detector 30 disposed in the surface of bat 20 is electrically connected to the circuit board 24, as is speaker 32. The bat will be held by the user so that the infrared detector is facing upwardly and capable of alignment with an IRLED on the user's cap as shown in FIG. 1.

Figure 3:
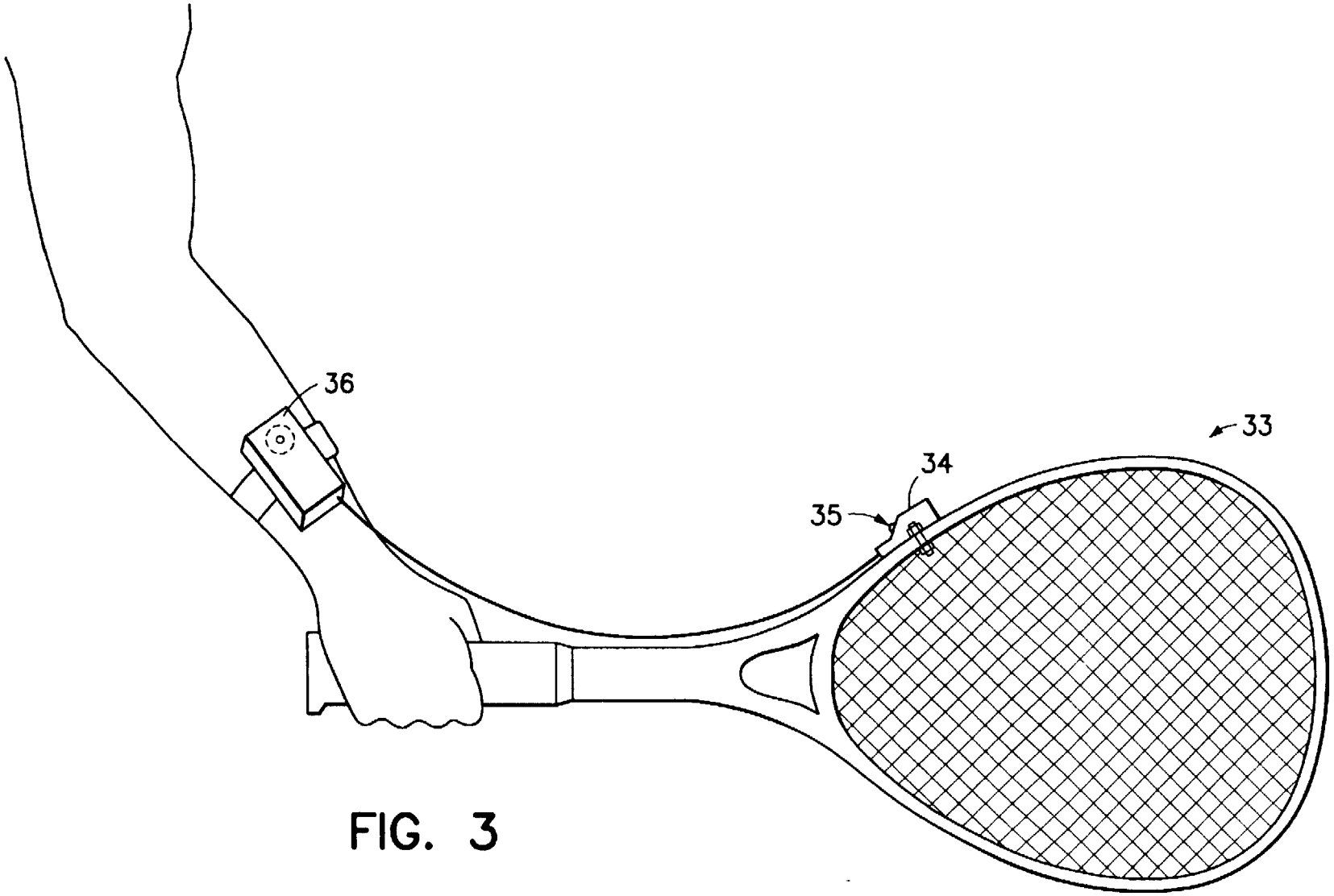
FIG. 3 is a side view of a tennis racquet showing in schematic view a radiation detector and an impact detector and a light signaling means mounted on the tennis racquet, and circuit means and sound-producing means strapped to the wrist of the user.
Figure 4:
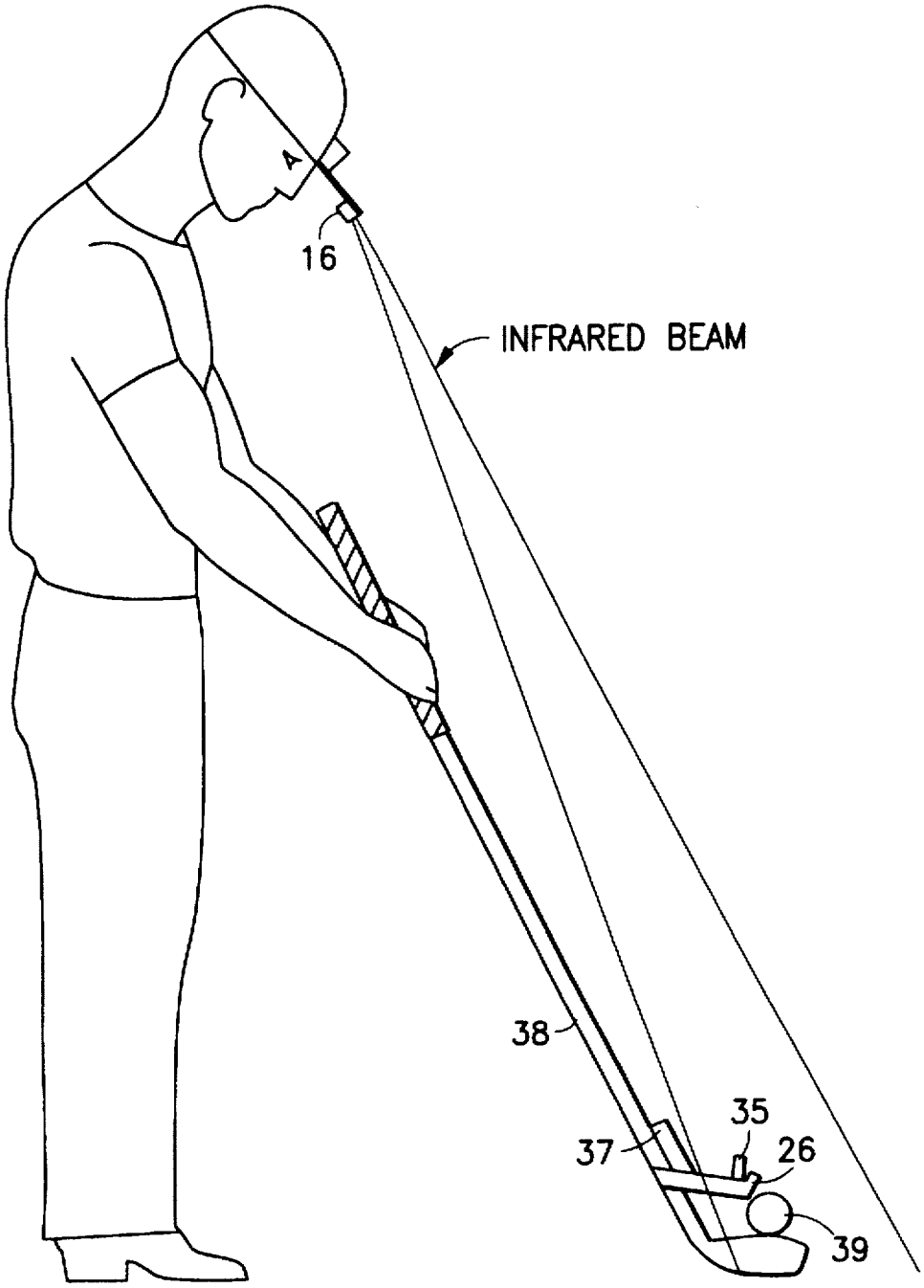
FIG. 4 is a perspective view of a user wearing a cap, said cap having the radiation-emitting means shown in schematic, also showing a golf club with radiation and impact-detecting means, circuit means and signaling means all mounted on the golf club shown in schematic.

In FIG. 3, a combined unit 34 housing an IR detector and an impact detector is shown mounted on a tennis racquet head 33 so as to be capable of alignment with an IRLED (not shown) disposed on the user's cap during the tennis stroke. A flashing light source such as LED 35 is also mounted on the racquet so as to be visible to the user. A sound-producing mechanism, such as a piezo buzzer enclosure 36, which buzzer is electrically connected to the combined IR and impact detector is shown on the user's wrist. The related circuitry is also enclosed within enclosure 36. It should be understood that the buzzer, and circuit board and batteries for producing the audible or visual signal need not be mounted on the user's forearm but, rather, these components may be mounted on the tennis racquet or other striking implement, either as a separate unit from the IR and impact detectors or combined in a single unit. In FIG. 4, for example, the impact detector, sound output means, and related circuitry are all mounted within enclosure 37 connected to golf club 38. Cantilevered from enclosure 37 is a lever arm having mounted thereon the IR detector 26 and light output means 35. The infrared detector must face upwardly in a direction to intercept the infrared beam from the IRLED 16 on the user's cap. The golf ball is represented at 39.

Figure 5:
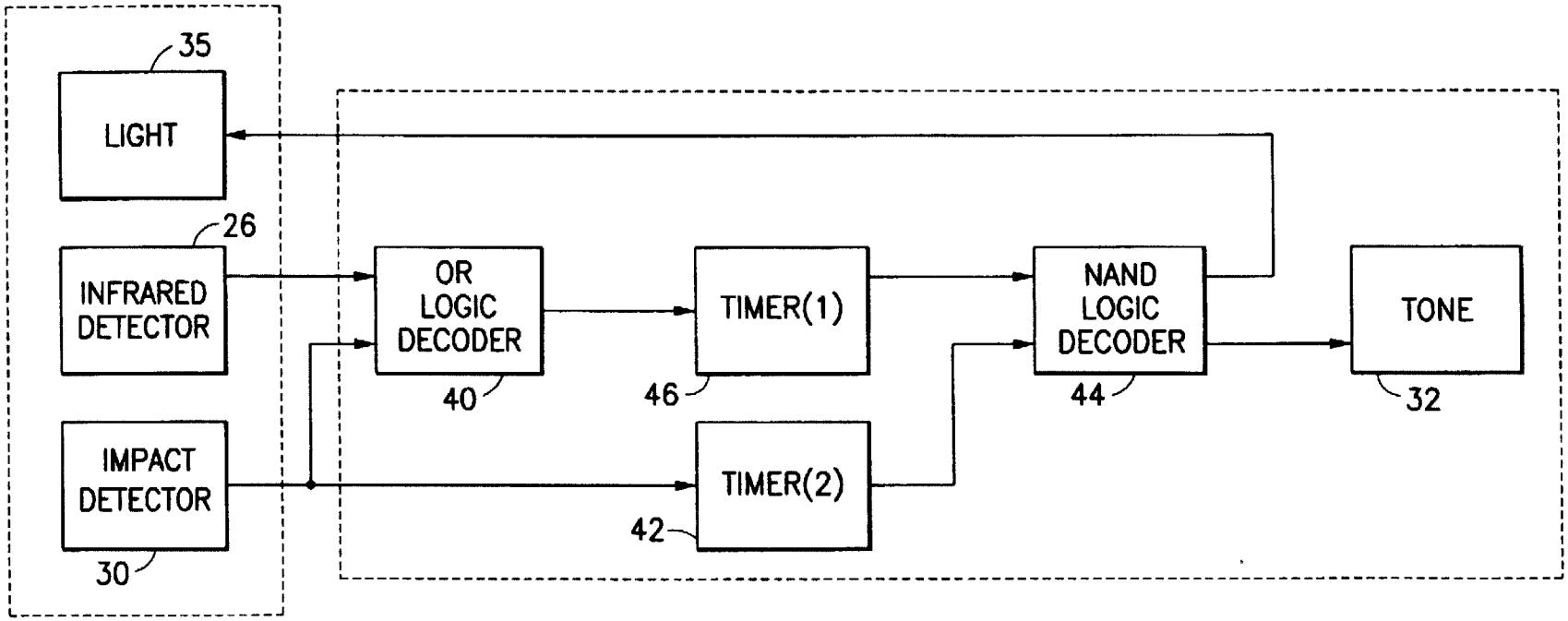
FIG. 5 is a block diagram of an electrical circuit of an embodiment of this invention which outputs an audible signal when there is improper alignment of user's eyes and the radiation detector when striking the ball, and a visual signal when there is proper alignment.

FIG. 5 is a block diagram of the circuit which outputs an audible tone signal when the user's eyes are not properly aligned with the IR detector on the striking implement and outputs a flash of light when there is proper alignment of the user's eyes and the IR detector, i.e., when there is proper alignment of the IRLED (aligned with the user's eyes), the IR detector on the striking implement and the object to be struck. FIG. 5 (as well as FIG. 7) may be used with any of the embodiments of FIGS. 1–4. The block diagram of FIG. 5 operates as follows:

1. Upon contact of the object to be struck and the striking implement, a signal is sent from the Impact Detector 30 (a microphone for example) to OR LOGIC DECODER 40 (for example, a 7432 OR gate used for decoding) as well as to activate Timer (2) 42. From Timer (2) 42 a signal is sent to NAND LOGIC DECODER 44.
2. When the user of the striking implement is looking at the infrared detector 26, the infrared detector 26 senses the infrared beam from the cap, and sends a signal to the OR LOGIC DECODER 40.
3. When the impact detection and infrared detection occur at the same time, Timer (1) 46 is activated and sends a signal to NAND LOGIC DECODER 44. The NAND LOGIC DECODER 44 outputs a signal to a light means (for example flashing light 35 of FIG. 3, which also may be mounted on the golf club or baseball bat). This indicates to the user that his technique is correct and that he is looking at the striking implement and object to be struck at the point of impact.
4. When the impact detection and infrared detection do not occur at the same time the NAND LOGIC DECODER 44 upon impact detection outputs a signal to an audio source, for example speaker 32 of FIG. 2. The user hearing the audio output will know after impact that his technique is improper, i.e., he is not looking at the striking implement and ball at the point of impact.

It should be understood that the light source 35 may be replaced with a sound source district from that provided by sound source 32 so that the user will hear two different sounds indicating proper and improper techniques, respectively. The sound sources may be spoken words (i.e., "nice shot", vs. "watch the ball") provided by a voice chip (see further discussion of FIG. 7), higher vs. lower frequency tones, etc. Further the sound source 32 may be replaced by a light source differentiated from that provided by light source 35. Still further, the visual or audible signal may be produced only when the alignment of eyes/implement/ball is proper, or only when that alignment is improper, by eliminating one of the outputs of FIG. 4.

All of the elements of FIG. 5 may be mounted on the bat, club or racquet, or the parts thereof other than 26, 30 and 35 may be mounted on the user's forearm (see FIG. 3).

Figure 6:
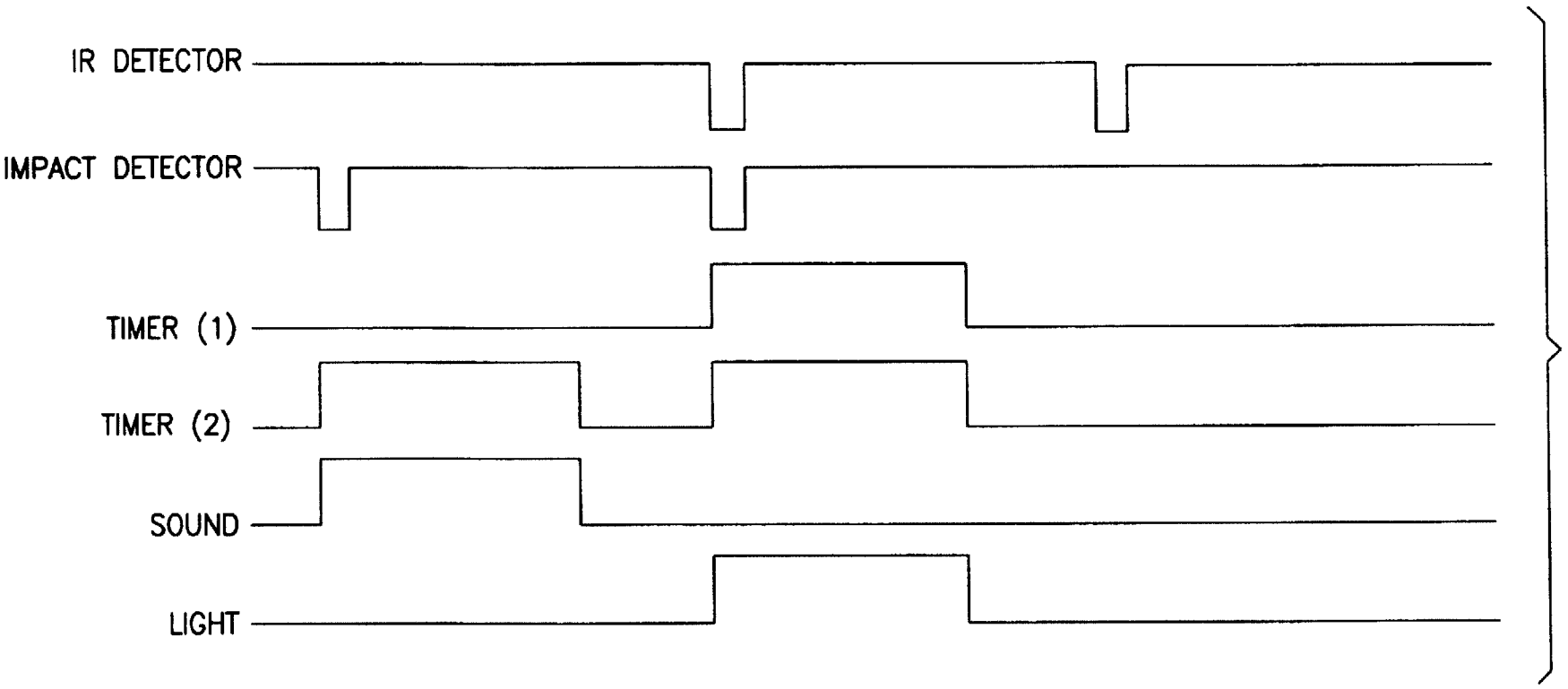
FIG. 6 is a timing diagram for the block diagram of Figure 5.

FIG. 6 is a timing diagram for the impact and IR detectors of FIG. 5. As illustrated, when the impact detector is activated (as shown by the signal going low on the impact detector line) and there is no simultaneous activation of the IR detector, this condition being shown to the left of the timing diagram, only Timer (2) 42 and sound output 32 are activated. However, when the impact and IR detectors are activated at the same time (as shown by the signals going low on their respective lines in the middle of FIG. 6), the output of OR LOGIC DECODER 40 goes low, Timer (1) 46 is activated, and light output 35 is activated. Now referring to the right of FIG. 6, when the IR detector is activated (as shown by its signal going low) without impact detection, there is neither light nor sound output. It should be appreciated that FIG. 6 is an idealization showing exact simultaneous outputs of the IR detector and impact detector activating the light output 35. However, as long as the output signals of the IR detector and impact detector overlap at all, the same result is achieved.

Figure 7:
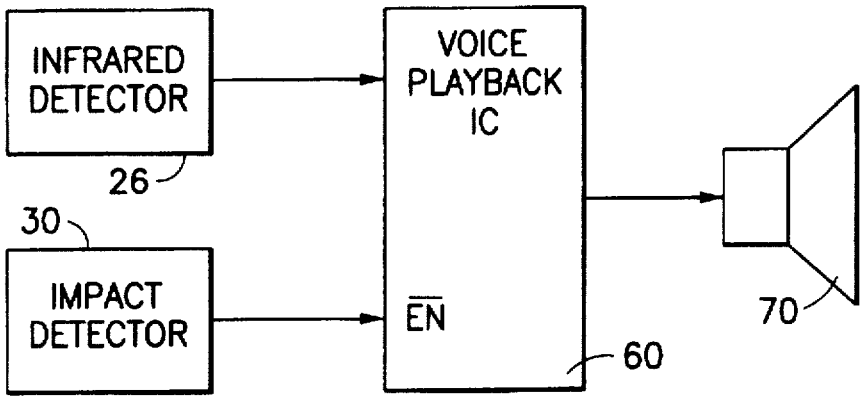
FIG. 7 is a block diagram of a further embodiment of this invention which outputs different voice messages depending upon whether there is proper or improper alignment of the user's eyes and the radiation detector.

FIG. 7 is a block diagram of a circuit for the aforedescribed voice chip embodiment. Striking the object activates the impact detector 30 which, in turn, enables the voice chip integrated circuit 60 (for example, an ISD 1000 A chip) during a short period of time. Upon enablement of the integrated circuit 60, a selection is made between two addresses. At one address, when the IR detector is aligned with the user's eyes, the integrated circuit will play back the stored expression "nice shot" through speech output means 70. If the user's eyes and the IR detector are not aligned while the chip is enabled, the integrated circuit will select the address that plays back the stored expression "watch the ball."

Figure 8:
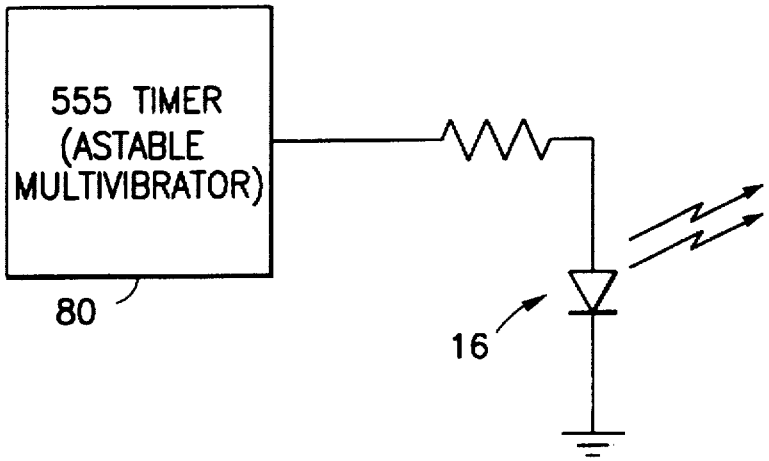
FIG. 8 is a circuit schematic for the radiation-emitting means.

FIG. 8 is a circuit schematic for the IRLED 16, the block 80 being a 555 timer (astable multivibrator).

Figure 9:
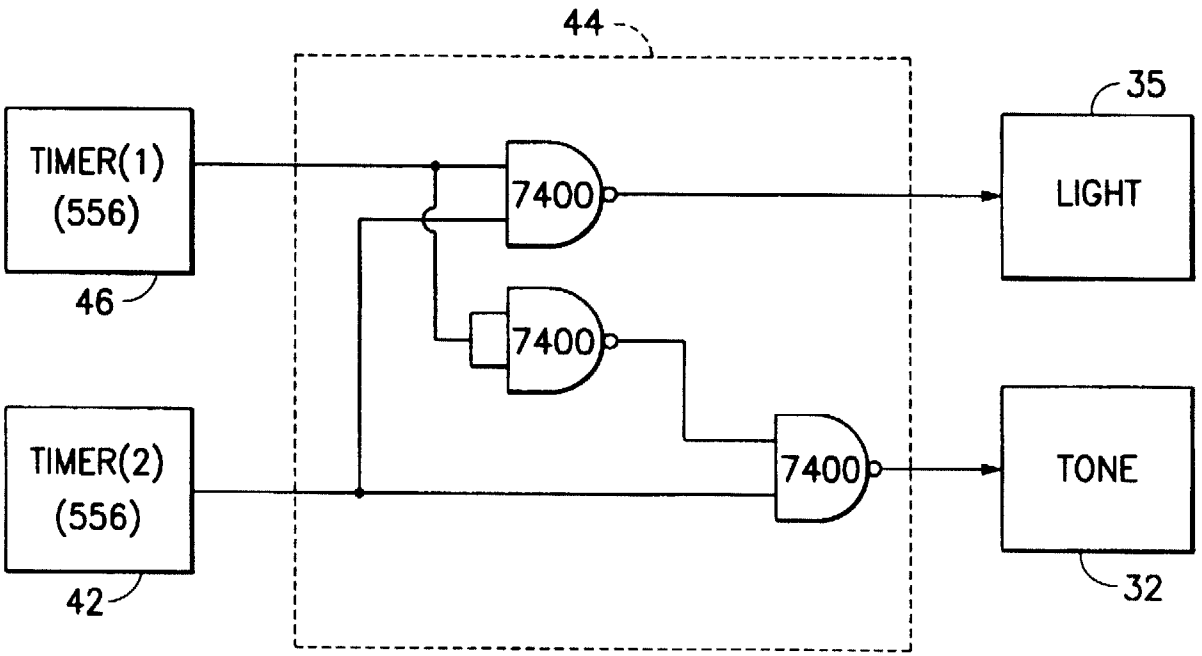
FIG. 9 is a circuit schematic of a portion of FIG. 5.

FIG. 9 illustrates a portion of FIG. 5 wherein NAND LOGIC DECODER 44 is shown comprised of three 7400 NAND gates connected as shown. When Timer (1) 46 is activated, it sends a high signal to NAND LOGIC DECODER 44; likewise, as to when Timer (2) 42 is activated, as shown in FIG. 6. Light source 35 is activated by a low NAND gate output signal. Sound source 32 likewise is activated by a low NAND gate output signal.

The present invention provides a very effective teaching tool for young and old alike in various sports. It can also be modified for various levels of skills, i.e. by providing an adjustable beam of light from IRLED in FIG. 1 allowing a wider beam for novices and a narrower beam for more experienced players of the sport in question. Wider beams of course will activate the IR detector when the user is looking fairly close to but not exactly at the striking implement and ball, whereas a narrower beam will require greater precision as expected in a more advanced player. The narrower beam can be obtained by a member with a smaller opening being slidable over the front of the IRLED.

Many possible embodiments may be made without departing from the scope hereof; it is to be understood that all description herein set forth or shown in the accompanying drawings is to be interpreted as illustrative and not in a limiting sense.

I claim:

1. An apparatus for practicing the swing of a sports implement in relation to an object to be struck, to train the user to align his eyes with the sports implement and object to be struck at the time of contact between the sports implement and object, comprising:

means to be worn on the head of the user for projecting a beam of radiation from the forehead of the user in the direction of the user's straight-ahead vision as the user swings the sporting implement;

a radiation detector means to be disposed on the sporting implement, which detector means includes means for producing a signal when the user's eyes and the radiation detector means are aligned;

impact detector means to be disposed on the sporting implement which produces a signal upon striking the object with the sporting implement; and circuit means for processing the signals from the radiation detector means and the impact detector means so as to produce a visual or audible signal output upon impact detection.

2. The apparatus of claim 1, wherein a visual or audible output is produced when the radiation detector means and impact detector means are essentially simultaneously activated.

3. The apparatus of claim 1, wherein a visual or audible output is produced when the radiation detector means and impact detector means are not essentially simultaneously activated.

4. The apparatus of any of claim 1, wherein one visual or audible output is produced when the radiation detection means and impact detection means are essentially simultaneously activated and a differentiated second visual or audible output is produced when the radiation detection means and impact detection means are not essentially simultaneously activated.

5. The apparatus of claim 1, wherein the projected radiation is infrared and the radiation detector is an infrared detector.

6. The apparatus of any of claims 1–5, and further wherein the object to be struck is a tennis ball and the sporting implement is a tennis racquet.

7. The apparatus of any of claims 1–5, and further wherein the object to be struck is a baseball and the sporting implement is a baseball bat.

8. The apparatus of any of claims 1–5, and further wherein the object to be struck is a golf ball and the sporting implement is a golf club.

9. The apparatus of claim 1, wherein the means to be worn on the head of the user is a cap having a peak extending from the cap and the radiation means is a self-contained infrared projecting unit disposed on the peak of the cap so as to project infrared rays in alignment with the direction in which the eyes of the user are looking.

10. The apparatus of claim 9, and further wherein the radiation detector means is an infrared detector, said detector being disposed on the sporting implement in such a manner so as to be capable of detecting the infrared radiation when the user's eyes are aligned with the striking surface of the sporting implement.

11. The apparatus of claims 9 or 10, and further wherein the object to be struck is a tennis ball and the sporting implement is a tennis racquet.

12. The apparatus of claims 9 or 10, and further wherein the object to be struck is a baseball and the sporting implement is a baseball bat.

13. The apparatus of claims 9 or 10, and further wherein the object to be struck is a golf ball and the sporting implement is a golf club.

14. The apparatus of claims 1–5 wherein the circuit means is to be disposed on the sporting implement.

15. The apparatus of claim 1, further including means to vary the beam width.

16. The invention of claim 1, wherein the circuit means includes an OR logic decoder, a first timer, a second timer and a NAND logic decoder, the radiation detector and impact detector outputs providing inputs to the OR logic decoder, the impact detector output also providing an input to the second timer, the OR logic decoder output providing an input to the first timer, the first and second timer outputs respectively providing inputs to the NAND logic decoder, the NAND logic decoder providing at least one output as an input to a visual or audio source.

17. The invention of claim 16, wherein the NAND logic decoder is comprised of three NAND gates.

18. The invention of claim 1, wherein the radiation detector and impact detector provide outputs to a voice playback integrated circuit chip.

* * * * *